US009290999B2

(12) United States Patent
Stenberg et al.

(10) Patent No.: US 9,290,999 B2
(45) Date of Patent: Mar. 22, 2016

(54) HARD METAL INSERT FOR A DRILL BIT FOR PERCUSSION DRILLING AND METHOD FOR GRINDING A HARD METAL INSERT

(75) Inventors: Göran Stenberg, Fagersta (SE); Johan Wessberg, Fagersta (SE)

(73) Assignee: ATLAS COPCO SECOROC AB, Fagersta (SE)

( * ) Notice: Subject to any disclaimer, the term of this patent is extended or adjusted under 35 U.S.C. 154(b) by 894 days.

(21) Appl. No.: 13/498,031

(22) PCT Filed: Oct. 1, 2010

(86) PCT No.: PCT/SE2010/051053

§ 371 (c)(1),
(2), (4) Date: Mar. 23, 2012

(87) PCT Pub. No.: WO2011/043717

PCT Pub. Date: Apr. 14, 2011

(65) Prior Publication Data

US 2013/0048387 A1 Feb. 28, 2013

(30) Foreign Application Priority Data

Oct. 5, 2009 (SE) ..... 0901268

(51) Int. Cl.
*E21B 10/56* (2006.01)
*B24B 3/24* (2006.01)
(Continued)

(52) U.S. Cl.
CPC ..... *E21B 10/46* (2013.01); *E21B 10/36* (2013.01); *E21B 10/56* (2013.01)

(58) Field of Classification Search
CPC ... E21B 10/567; E21B 10/56; E21B 10/5673; B24B 3/24
USPC ..... 175/420.1, 426; 51/307, 309; 76/108.1, 76/108.2, 108.4, 108.6; 451/48
See application file for complete search history.

(56) References Cited

U.S. PATENT DOCUMENTS 4,271,917 A * 6/1981 Sahley ..... 175/426
4,607,712 A 8/1986 Larsson
(Continued)

FOREIGN PATENT DOCUMENTS

JP 56126563 A 10/1981
JP 07-293173 A 11/1995
(Continued)

OTHER PUBLICATIONS

PCT/ISA/210—International Search Report—Dec. 22, 2010.
(Continued)

*Primary Examiner* — Catherine Loikith
(74) *Attorney, Agent, or Firm* — Venable LLP; Eric J. Franklin

(57) ABSTRACT

A hard metal insert for a drill bit for percussion drilling. A wear part includes a cap including a wear surface. A mount includes a cylindrical part having a cross-sectional area and a diameter. The cap includes a front part with an extension along an axis of symmetry of the insert from a first point on the wear surface to a second point in the cap. The front part includes a volume between a first plane intersecting the axis at the first point and a second plane intersecting the axis at the second point. The volume is ≥0.6 times a cross-sectional area of the front part in the second plane times a distance along the axis between the first and second points. A diameter of the front part in the second plane is ≥0.5 times the mount diameter and ≤0.6 times the mount diameter.

15 Claims, 9 Drawing Sheets

(51) Int. Cl.
*E21B 10/46* (2006.01)
*E21B 10/36* (2006.01)

(56) References Cited

U.S. PATENT DOCUMENTS

| | | | | |
|---|---|---|---|---|
| 4,776,413 | A | 10/1988 | Forsberg | |
| 5,794,728 | A * | 8/1998 | Palmberg | 175/400 |
| 2001/0040053 | A1 * | 11/2001 | Beuershausen | 175/57 |
| 2005/0109546 | A1 | 5/2005 | Stowe et al. | |
| 2008/0149399 | A1 | 6/2008 | Koch et al. | |

FOREIGN PATENT DOCUMENTS

| | | | |
|---|---|---|---|
| JP | 2002-242577 | A | 8/2002 |
| RU | 2100561 | C1 | 12/1997 |
| SE | 526 439 | C2 | 9/2004 |
| SE | 531596 | C2 | 4/2009 |
| WO | WO-9612086 | A1 | 4/1996 |
| WO | WO-0229198 | A1 | 4/2002 |
| WO | WO-2004/080651 | A1 | 9/2004 |
| WO | WO-2009/045142 | A1 | 4/2009 |

OTHER PUBLICATIONS

PCT/ISA/237—Written Opinion of the International Searching Authority—Dec. 22, 2010.

Chinese Patent Office—First Office Action W/ Translation—May 14, 2014 (Issued in Counterpart Application No. 201080044592.7).

Japanese First Office Action (With Translation) (Issued in Japanese Patent Application No. 2012-533114)—Jan. 7, 2015.

* cited by examiner

HARD METAL INSERT FOR A DRILL BIT FOR PERCUSSION DRILLING AND METHOD FOR GRINDING A HARD METAL INSERT

CROSS-REFERENCE TO RELATED APPLICATIONS

This application claims priority under 35 U.S.C. §119 to Swedish patent application 0901268-3 filed 5 Oct. 2009 and is the national phase under 35 U.S.C. §371 of PCT/SE2010/051053 filed 1 Oct. 2010.

TECHNICAL AREA

The present invention concerns a hard metal insert, a drill bit comprising at least one hard metal insert and a method for regrinding a worn insert.

THE PRIOR ART

Drill bits comprising a number of hard metal inserts are used for percussion drilling. The task of the hard metal inserts is to achieve during repeated blows against the drill bit the formation of cracks in the rock in which holes are to be drilled.

A hard metal insert consists of a cap, a cylindrical part and a bottom. The cap constitutes a part that is worn, while the cylindrical part together with the bottom constitutes the contact surface of the insert with the drill bit. The cap may have any one of several forms, such as spherical, semiballistic or fully ballistic. The orientation of the hard metal insert relative to the axis of symmetry of the drill bit differs, depending on the location of the insert in the drill bit.

The cap of the insert is worn during drilling, and in this way its shape is changed. The region of the insert that is worn during drilling forms a surface that will be referred to below as the "wear phase". The region of the insert that protrudes from the drill bit and that is exposed to wear will be referred to below as the "wear surface".

When the wear has progressed until the area of the wear phase is of the order of 25% of the cross-sectional area of the cylindrical part of the insert, it is appropriate to restore the insert to its original capped form by grinding. The cap part of the insert is consumed in height during drilling through wear, and the total length of the insert thus becomes less during each drilling stage.

There is a direct correlation between the depth of penetration and the size of the contact surface between the insert and the rock. There is a direct correlation also between the depth of penetration and the magnitude of the force in the shock wave.

For an insert that has the same original form, more power is required to hammer in a comparatively more worn insert a given distance into rock than is required to hammer in a less worn hard metal insert. This means that it takes comparatively more time and requires more force to drill a hole of a given stretch with a drill bit that comprises worn hard metal inserts.

This means that the drill bit is pressed into the rock to different depths, depending on how worn the component inserts are, i.e. depending on the size of the contact surface between insert and rock. A larger contact area gives a lower penetration into the rock. Thus the drilling rate, which is here defined as the length of hole drilled per unit time, will fall during a drilling stage that is carried out with the same drill bit and inserts. One of the reasons that the insert is reground is thus to ensure a relatively high drilling rate during the complete lifetime of the bit.

A hard metal insert can be reground several times to its original cap form. The number of times that an insert can be reground depends on many factors, including the length of the insert, the height of the cap and the required size of the contact surface between the insert and the drill bit.

The lifetime of the drill bit depends on the rate of wear of the hard metal insert, measured as the reduction in length of the insert per drilled meter of hole. The production costs for drilling holes in rock depend on the lifetime of the drill bit, and thus in turn on the reduction in length of the inserts that are components of the bit per drilled meter of hole.

There is a need for hard metal inserts that can be reground, that optimise the production costs for percussion drilling of holes in rock.

SUMMARY OF THE INVENTION

One purpose of the invention is to offer a hard metal insert the use of which is economically advantageous for percussion drilling. A second purpose of the invention is to offer a method for the regrinding to the required form of hard metal inserts for percussion drilling in rock.

According to a first aspect of the invention, this purpose is achieved by offering a hard metal insert intended to be mounted in a drill bit for percussion drilling. The hard metal insert comprises a cap, which constitutes a wear part comprising a wear surface and a cylindrical part, which constitutes a mount with a cross-sectional area A and a diameter D. The cap comprises a front part with an extension H along the axis of symmetry x of the insert from a first point on the wear surface of the cap to a second point in the cap. The front part constitutes a volume Vf between a first plane I, which intersects at right angle to the axis of symmetry at the first point, and a second plane II, which intersects at right angle to the axis of symmetry at the second point.

The front part 4 constitutes a volume Vf between a first plane I, which intersects at right angle to the axis of symmetry x at a first point a, and a second plane H, which intersects at right angle to the axis of symmetry x at a second point b.

The magnitude of the cylindrical volume V, which describes the front part 4, can be expressed as follows:

$$V=Af\times H$$

where

Af is the cross-sectional area of the front part at the second plane II, and

H is the distance along the axis of symmetry x between the first point a and the second point b.

The ratio Vf/V is a volume ratio that specifies how large a part of the volume of the surrounding cylinder is occupied by the front part.

The solution according to the invention specifies an insert that has a front part with a certain extent along the axis of symmetry of the insert and furthermore has a certain volume. The volume ratio defined above according to the invention gives a front part that defines a comparatively blunt wear surface.

An insert designed to have the volume ratio defined above greater than or equal to 0.6 has a comparatively large volume of hard metal material in the front part of the cap, i.e. the part that penetrates into the rock and breaks it.

This is the case under the condition that the cross-sectional area Df of the front part in the second plane II has a certain length relative to the diameter D of the mount, as follows:

$$0.5\times D\leq Df\leq 0.6\times D$$

where Df is the cross-sectional diameter of the front part.

Each individual insert in a drill bit has a contact surface with rock during drilling.

The total contact surface between the insert in a drill bit and rock defines the distance to which the bit can be pressed into the rock for a certain force. The requirements for strength of the inserts and the resistance to wear of the inserts principally depend on the distance to which the inserts are pressed into the rock and how far out along any particular insert the contact surface is located.

A comparatively large contact surface for an insert in a drill bit, defined as described above, gives a comparatively longer lifetime during drilling. A point-formed contact surface, thus, is worn more than a contact surface that has a certain extent.

The contact surface described above initiates a zone of crushing in the rock. It is the aim when drilling that the zone of crushing in the rock be larger than the volume or contact area of the insert that is pressed into the rock. The zone of crushing in this way depends partially on the contact area.

The purpose of the design of a drill bit according to the invention is, among other purposes, that the total zone of crushing in the rock that is achieved by the insert according to the invention shall lead to crushing of a hole with a larger diameter than the maximum diameter of the drill bit.

The zone of crushing depends, naturally, on whether the rock type under consideration is, for example, hard, soft, ductile, brittle or permeated by cracks, or has a combination of the these properties.

A comparatively large zone of crushing results in a larger volume of processed rock for each blow or shock wave. This, in turn, makes it possible to drill a higher number of meters of hole with the insert and drill bit.

Inserts designed according to the volume ratio, Vf/V, defined above make possible an essentially constant contact surface between the insert and rock during a drilling operation. This results in comparatively low variation in the depth of penetration into the rock, and thus it results in also the drilling rate, i.e. the length of hole drilled per unit time, varying only insignificantly.

A greater amount of hard metal in the front part of the cap ensures a longer operating time for the inserts between regrinding operations, and thus longer lifetime. This in turn gives a drill bit with comparatively longer lifetime, which reduces the cost per meter of drilled hole.

Furthermore, a greater amount of hard metal in the front part of the cap gives the possibility of replacing currently available inserts by an insert with a smaller diameter, thus obtaining more space for each insert, which will increase the drilling rate and shorten the time required to produce boreholes.

An alternative according to the invention specifies a front part with a wear surface comprising a first and a second spherical part. A second alternative according to the invention specifies a front part with a wear surface comprising an essentially plane front part and a spherical part. A further alternative according to the invention specifies a front part with a wear surface comprising an essentially plane front part and a conical part.

All alternative designs within the innovative concept of the invention result in a lower wear in the height of the insert according to the invention for a given volume of hard metal material worn away from an insert during drilling than was the case for previously known inserts. The term "wear in the height" is in this context used to denote a reduction in the extent of the front part that is a component of the cap along the axis of symmetry of the insert.

In one design of the invention, the said diameter Df of the front part is 0.5 times or, alternatively, 0.6 times the diameter D of the mount.

According to a second aspect of the invention, its purpose is achieved by offering a method to grind an insert for percussion drilling in which the insert comprises not only a cap, which constitutes a wear part comprising a wear surface, but also a cylindrical part, which constitutes a mount with a cross-sectional area A and a diameter D. The method comprises grinding the cap and forming a front part with an extension H along the axis of symmetry of the insert from a first point on the wear surface of the cap to a second point in the cap such that the front part constitutes a volume between a first plane, which intersects at right angle to the axis of symmetry at the first point, and a second plane, which intersects at right angle to the axis of symmetry at the second point. The magnitude of the volume is equal to 0.6 times the cross-sectional area Af of the front part in the second plane II times the distance H along the axis of symmetry between the first point a and the second point b. The diameter Df of the front part in the second plane is greater than or equal to 0.5 times the diameter D of the mount and less than or equal to 0.6 times the diameter D of the mount, where the volume Vf of the front part corresponds to the lowest possible volume of hard metal that it is intended should be worn away during drilling before the insert is reground.

which intersects at right angle to the axis of symmetry at a first point which intersects at right angle to the axis of symmetry at a second point The bluntness, as defined above, of the front part of the cap contributes to it being necessary to grind away a lower mass when the insert is reground such that its form is restored. In comparison with previously known inserts, such as spherical, fully ballistic and semiballistic inserts, the insert according to the invention is designed such that there is more volume of hard metal available to be worn away before it requires regrinding. The length H of the insert that must or can be worn before a regrinding operation is comparatively shorter than the corresponding length of, for example, a semiballistic or standard insert. An insert according to the invention will be shortened during each regrinding operation comparatively less than a traditional insert is shortened. The drill bit in which the insert is located will, thus, have a longer lifetime.

The factor that limits the number of regrinding operations is the minimum length of the insert that is required for a functional mounting into a drill bit. The height of the cap is also a limiting factor for the number of regrinding operations possible.

SUMMARY OF THE DRAWING

It should be pointed out that the drawings have not been drawn to scale.

DETAILED DESCRIPTION OF ALTERNATIVE EMBODIMENTS

A hard metal insert 1 according to the invention (FIG. 1) comprises a cap 2, which constitutes a wear part comprising a wear surface 2*a* and a cylindrical part 3, with a diameter D and a cross-sectional area A. The cap 2 comprises a front part 4 with an extension H along the axis of symmetry x of the insert from a first point a on the wear surface 2*a* of the cap to a second point b in the cap.

Figure 2:
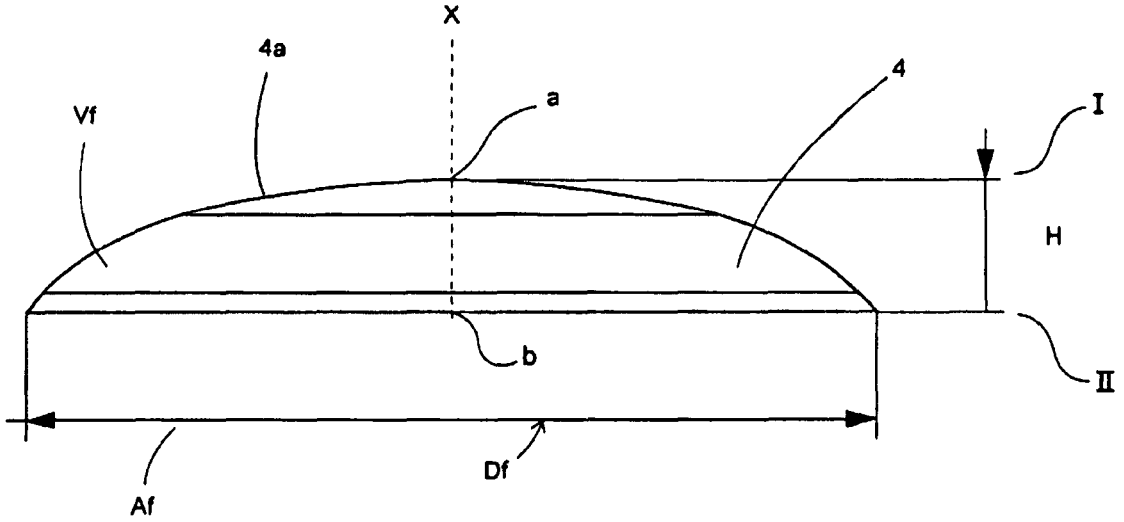
FIG. 2 shows the front part of the insert in FIG. 1.

The plane II in FIG. 2 intersects through the cap 2 at the point b on the axis of symmetry x and the cross-section Af of the cap 2 is circular with a diameter Df. The diameter Df of the cross-section of the insert shown in FIG. 2 has been set at half of the diameter D of the cylindrical part. The wear surface 4*a* of the front part constitutes a part of the wear surface 2*a* of the cap.

The ideal insert is a cylindrical insert, i.e. an insert that has a front part with a volume ratio Vf/V, as defined above, that is equal to 1. Such an insert does not need to be reground since it has a constant depth of penetration. The problem is that the diameter of the insert then must be half of the insert diameter currently used such that the area does not become too large, since the shock wave must have sufficient force to press the insert into the rock. Such a cylindrical insert would not be able to withstand the mechanical load.

Figure 3A:
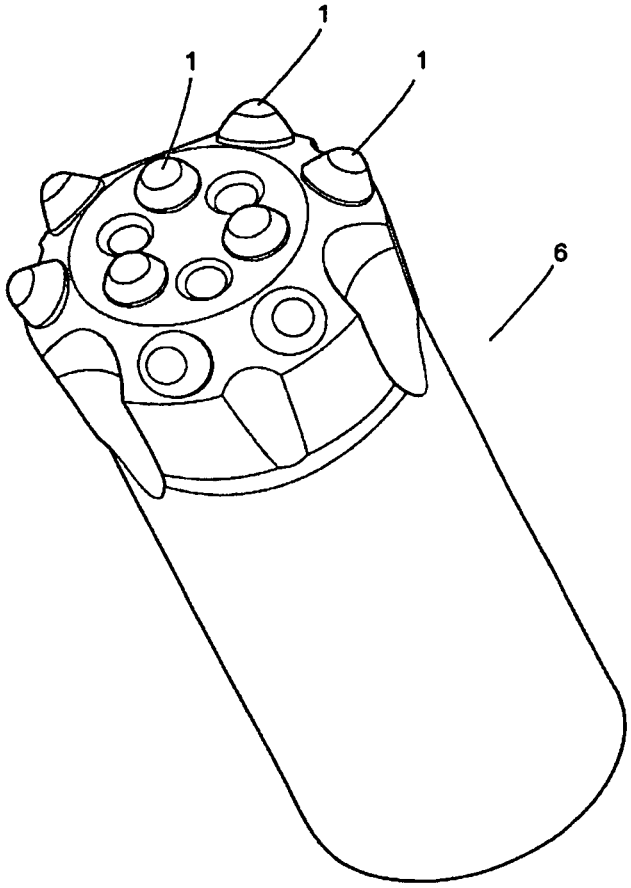
FIG. 3*a* shows a drill bit comprising at least one hard metal insert according to FIG. 1.

FIG. 3*a* shows a drill bit 6 comprising a number of hard metal inserts 1 according to the invention.

Figure 3B:
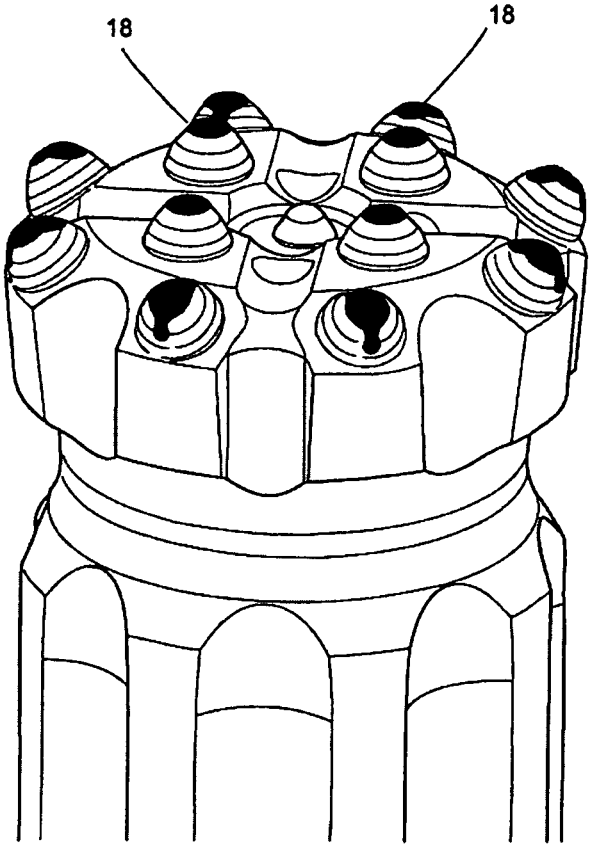
FIG. 3*b* shows the contact surfaces between insert and rock during drilling with an alternative drill bit.

FIG. 3*b* shows the contact surface 18 between individual inserts in a drill bits and rock (not shown in the drawing) in an alternative drill bit at a certain depth of penetration. FIG. 3*b* shows that the sizes and forms of the contact surfaces 18 differ, depending on the location of the insert in the drill bit and the angle that the axis of symmetry of the insert has relative to the axis of symmetry of the drill bit.

The orientation of a hard metal insert in a drill bit differs greatly, depending on the type and size of the drill bit and the location of the insert in the drill bit. One method of describing the orientation is to specify an angle V2, which is the angle that the axis of symmetry/longitudinal axis of the insert has relative to the axis of symmetry/longitudinal axis of the drill bit.

The hard metal insert according to the present invention is intended to be arranged with an angle V2 that lies in the interval 0 to 45 degrees.

Figure 1:
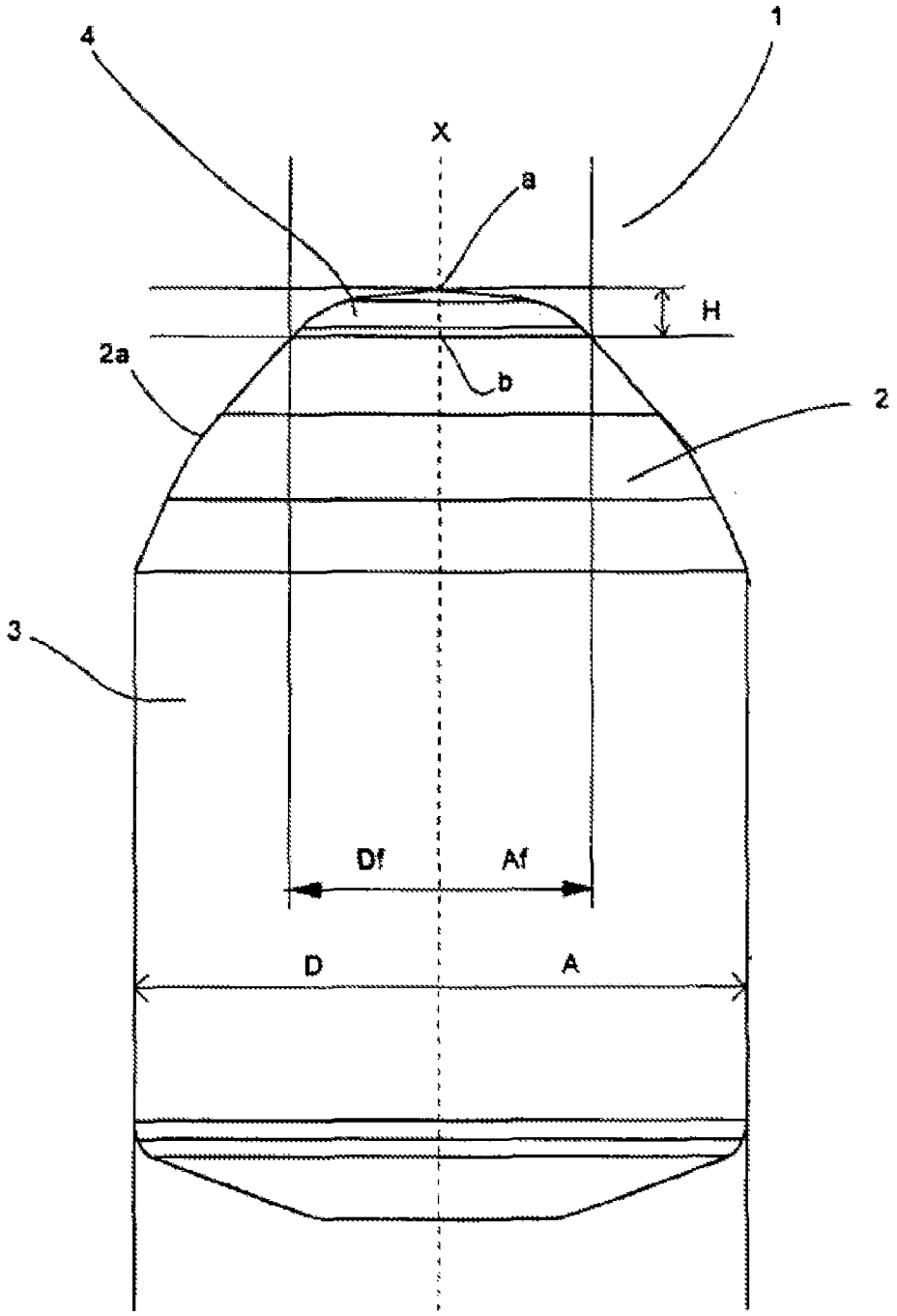
FIG. 1 shows a hard metal insert according to the invention.

One advantage of the present invention is that a hard metal insert according to FIG. 1, arranged with the angle V2 such that the angle is in accordance with the peripheral angle of the drill bit, has a comparatively larger area in contact with the wall of the hole. A larger area making contact with the wall of the hole in the rock leads to a reduced wear in the diameter of the drill bit. The angle V2 in this case is approximately 35 degrees.

Figure 4:
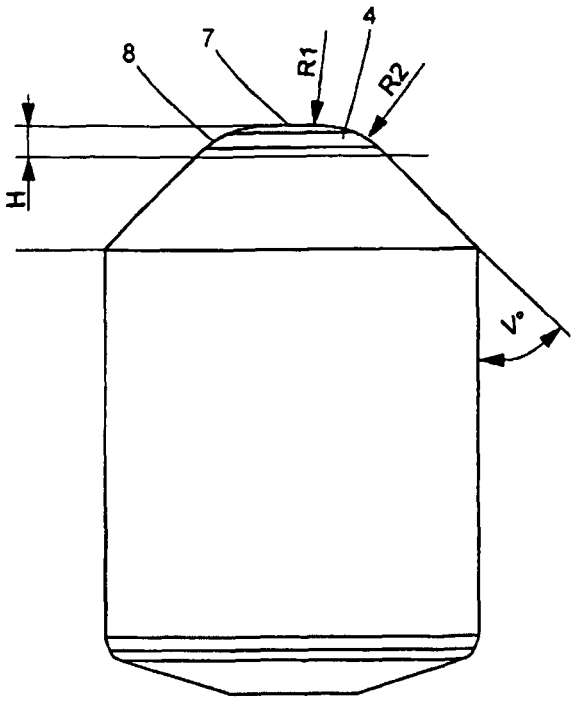
FIGS. 4-6 show alternative embodiments of the insert according to the invention.

FIG. 4 shows an embodiment of an insert comprising a front part with a form according to the invention defined as described above and denoted by "blunt". The front part 4 comprises a first spherical part 7 with radius R1 and a second spherical part 8 with radius R2, where radius R1 is greater than radius R2.

Figure 5:
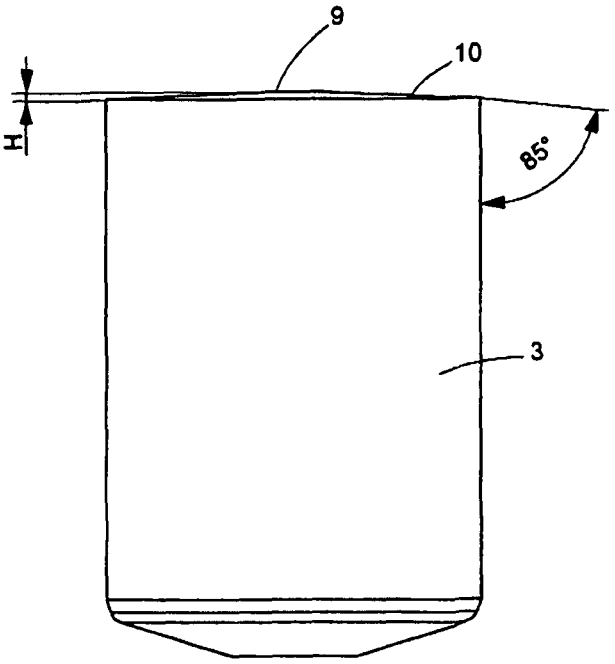

FIG. 5 shows an alternative embodiment of the insert according to the invention with a front part 4 comprising a plane front surface 9 and a conical part 10 between the front surface 9 and the cylindrical part 3. The front part in this embodiment coincides with the cap.

Figure 6:
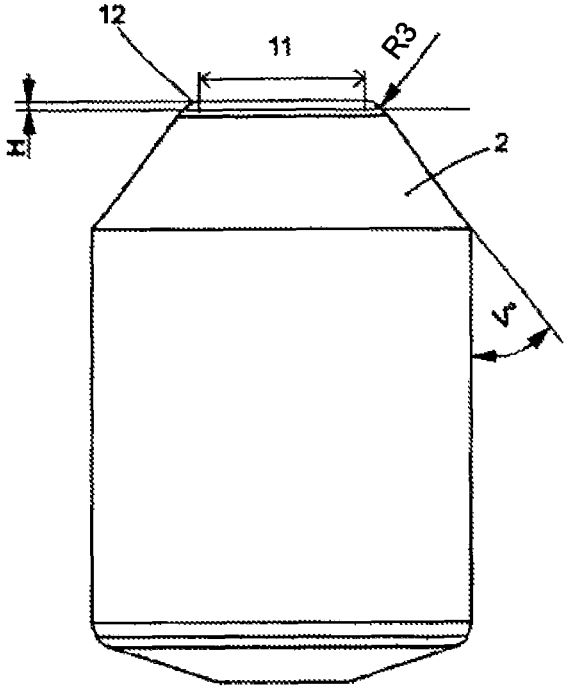

FIG. 6 shows an alternative embodiment of the insert according to the invention with a front part 4 comprising a plane front surface 11 and a spherical part 12 having a radius R3 between the front surface 11 and the cap 2.

Figure 7:
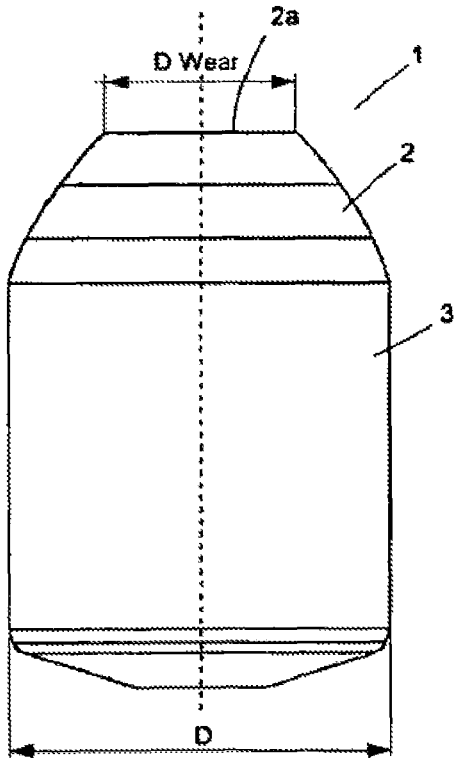
FIG. 7 shows an insert according to FIG. 1 that has been worn to a certain degree.

FIG. 7 shows an insert according to the invention worn to such a degree that the diameter Dwear of the wear surface 2*a* is 50% of the diameter D of the cylindrical part.

Figure 8:
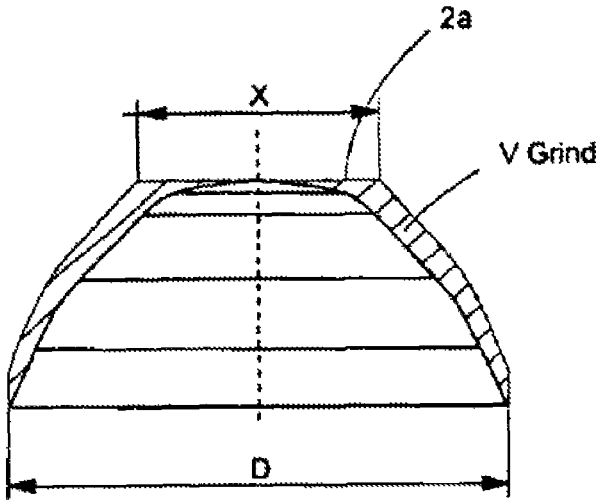
FIG. 8 shows an enlargement of the cap part in FIG. 7.

FIG. 8 shows the cap of an insert 1 with the wear surface 2*a* worn to a degree that agrees with the degree shown in FIG. 7. During regrinding of the insert to its original form, removal of a volume Vgrind takes place, as shown by the hatching in the drawing. The drawing makes it clear that the extent of the cap along the axis of symmetry of the insert is not affected during a regrinding operation.

It has already been pointed out that the length of the insert should not be affected by the regrinding operation, while a fraction of the working volume of the insert is ground away in order to re-attain the desired form of the insert.

Figure 9:
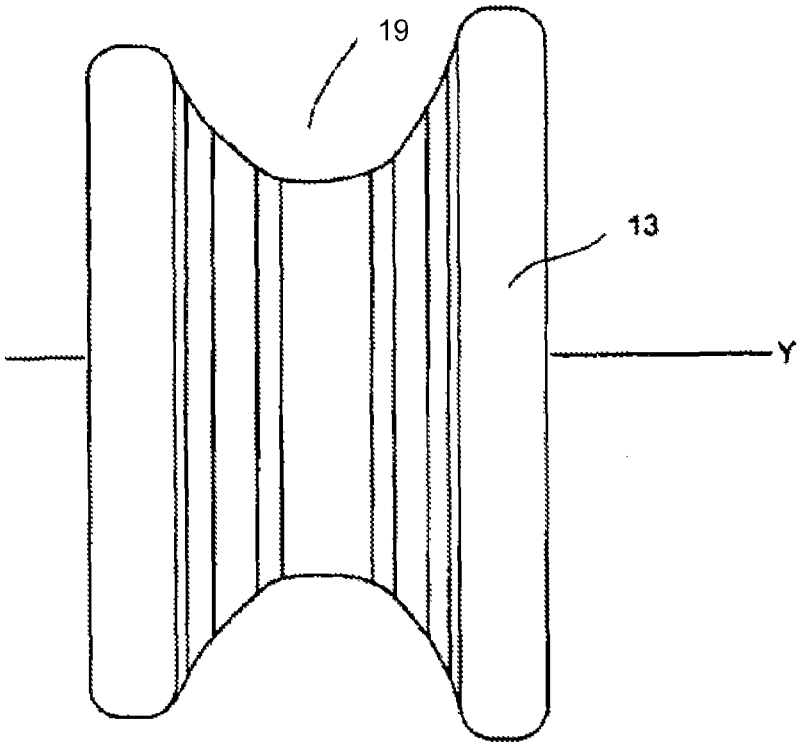
FIG. 9 shows schematically a representation of a grinding body.

FIG. 9 shows a grinding body 13 with an axis of rotation Y intended to be used in a grinding machine (not shown in the drawing). The grinding body comprises a groove 19 that is designed adapted to the hard metal insert according to FIG. 1. It is part of the innovative concept of the invention that the grinding roller be formed such that it is compatible with the alternative designs of hard metal inserts that are within the scope of the innovative concept.

Figure 10:
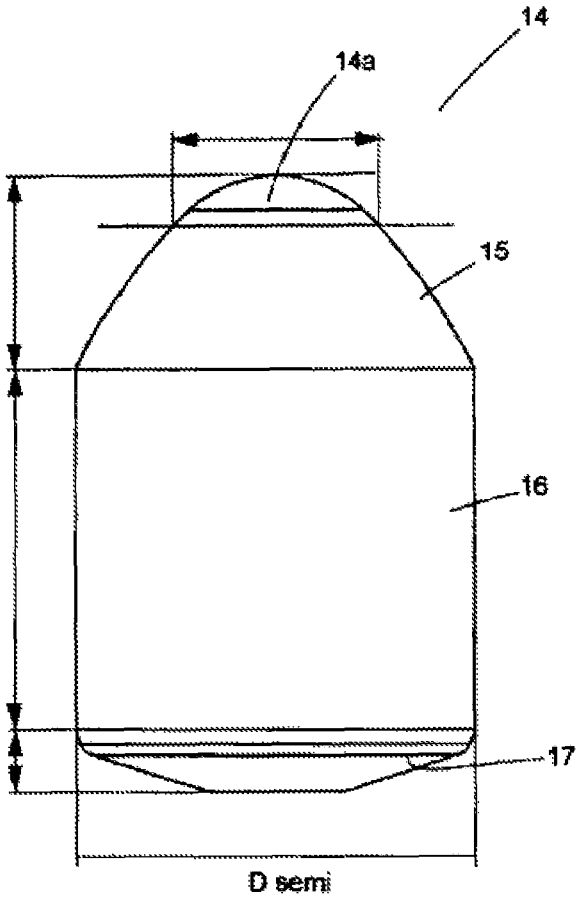
Fig. 10 (Prior Art)
FIG. 10 shows a semiballistic insert according to the prior art.
Figure 11:
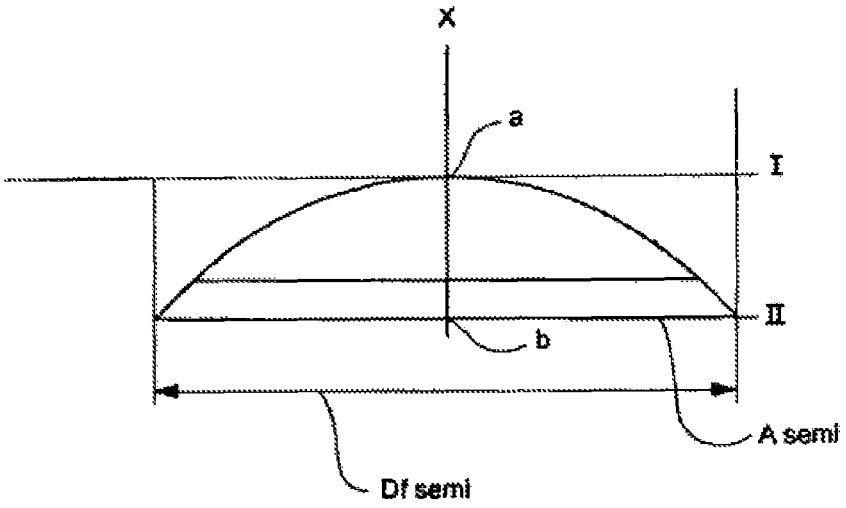
Fig. 11 (Prior Art)
FIG. 11 shows the front part of the insert in FIG. 10.

FIGS. 10-14 show prior art technology in the form of a standard semiballistic insert. FIG. 10 shows an unused semiballistic insert 14 comprising a cap 15, a cylindrical part 16 and a bottom 17. FIG. 11 shows the front part 15*a* of the insert 14 in FIG. 10. In comparison with FIG. 2, a corresponding plane II intersects through the cap 15 at the point b on the axis of symmetry x and the cross-section Asemi of the cap 15 is circular with a diameter Dfsemi. The diameter Dfsemi of the cross-section of the insert shown in FIG. 11 has been set at half of the diameter Dsemi of the cylindrical part.

Calculation of the volume ratio according to the invention for the insert 14 gives a comparatively low value. The front part of the insert 14 thus contains a comparatively lower volume of hard metal material to be worn away before regrinding. The distance along the axis of symmetry x between the first point a and the second point b is comparatively greater. The insert can thus be described as an insert that is to be reground after a lower volume of hard metal has been worn away, i.e. more often than the insert according to the present invention.

Figure 12:
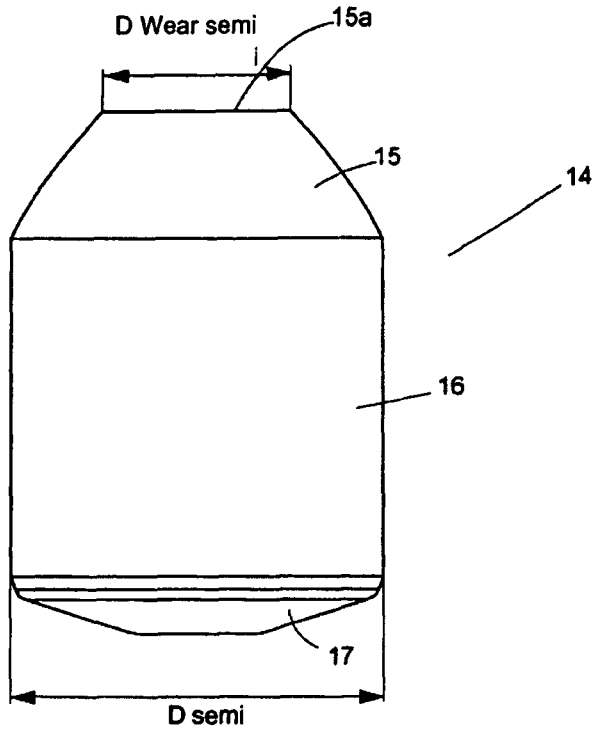
Fig. 12 (Prior Art)
FIG. 12 shows an insert according to FIG. 11 that has been worn to a certain degree.

FIG. 12 shows a semiballistic insert according to the prior art that has been worn to such a degree that the diameter Dwearsemi of the wear surface 15*a* is 50% of the diameter Dsemi of the cylindrical part.

Figure 13:
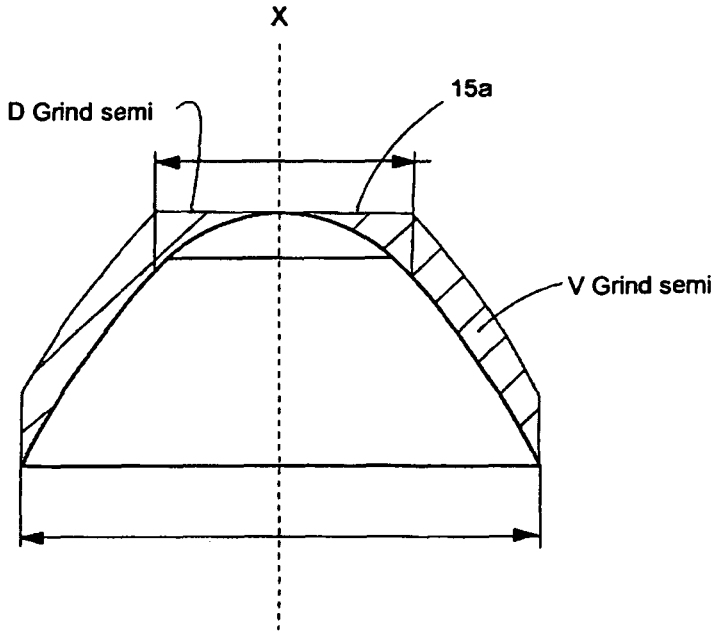
Fig. 13 (Prior Art)
FIG. 13 shows an enlargement of the cap part in FIG. 12.

FIG. 13 shows the cap of an insert 14 with the wear surface 14*a* worn to a degree that agrees with the degree shown in FIG. 12. During regrinding of the insert to its original form, removal of a volume Vslipsemi takes place, as shown by the hatching in the drawing. The drawing makes it clear that the extent of the cap along the axis of symmetry of the insert is not affected during a regrinding operation. A greater volume of hard metal will, however, be ground away during each regrinding operation to the original form than is the case when regrinding the insert according to the present invention.

The invention claimed is:

1. A hard metal insert for a drill bit for percussion drilling, the insert comprising:

a wear part comprising a cap comprising a wear surface, wherein the wear part is rotationally symmetrical about a longitudinal axis of the wear part and the cap and wear surface extend entirely around the longitudinal axis; and a mount comprising a cylindrical part having a cross-sectional area and a diameter;

wherein the cap comprises a front part with an extension along an axis of symmetry of the insert from a first point on the wear surface of the cap to a second point in the cap, wherein the front part comprises a volume between a first plane, which intersects at right angle to the axis of symmetry at the first point and a second plane, which intersects at right angle to the axis of symmetry at the second point, wherein the volume is greater than or equal to 0.6 times a cross-sectional area of the front part in the second plane times a distance along the axis of symmetry between the first point and the second point, wherein a diameter of the front part in the second plane is greater than or equal to 0.5 times the diameter of the mount and less than or equal to 0.6 times the diameter of the mount, and wherein a height of the extension is less than half the diameter of the extension.

2. The hard metal insert according to claim 1, wherein the wear surface comprises a first spherical part and a second spherical part.

3. The hard metal insert according to claim 1, wherein the wear surface comprises an essentially plane front part and a spherical part with a radius.

4. The hard metal insert according to claim 1, wherein the wear surface comprises an essentially plane front part and a conical part.

5. The hard metal insert according to claim 1, wherein the diameter of the front part is 0.5 times the diameter of the mount.

6. The hard metal insert according to claim 1, wherein the diameter of the front part is 0.6 times the diameter of the mount.

7. The hard metal insert according to claim 1, wherein the hard metal insert can be reground.

8. The hard metal insert according to claim 1, wherein the height of the extension is less than one third the diameter of the extension.

9. The hard metal insert according to claim 1, wherein a curvature of a surface of the extension varies over the surface.

10. A drill bit for percussion drilling, the drill bit comprising:

a bit body having a longitudinal axis;

a plurality of hard metal inserts arranged at a first end of the bit body, each insert comprising a wear part comprising a cap comprising a wear surface, wherein the wear part is rotationally symmetrical about a longitudinal axis of the wear part and the cap and wear surface extend entirely around the longitudinal axis; and a mount comprising a cylindrical part having a cross-sectional area and a diameter;

wherein the cap comprises a front part with an extension along an axis of symmetry of the insert from a first point on the wear surface of the cap to a second point in the cap, wherein the front part comprises a volume between a first plane, which intersects at right angle to the axis of symmetry at the first point and a second plane, which intersects at right angle to the axis of symmetry at the second point, wherein the volume is greater than or equal to 0.6 times a cross-sectional area of the front part in the second plane times a distance along the axis of symmetry between the first point and the second point, wherein a diameter of the front part in the second plane is greater than or equal to 0.5 times the diameter of the mount and less than or equal to 0.6 times the diameter of the mount, wherein a height of the extension is less than half the diameter of the extension, and wherein the inserts are arranged at a plurality of angles with respect to the longitudinal axis of the bit body.

11. The drill bit according to claim 10, wherein an angle of the axis of symmetry of the insert relative to a longitudinal axis of the drill bit is approximately 35 degrees.

12. The drill bit according to claim 11, wherein the height of the extension is less than one third the diameter of the extension.

13. The drill bit according to claim 10, wherein the height of the extension is less than one third the diameter of the extension.

14. A method for grinding a hard metal insert intended to be included within a drill bit for percussion drilling, the insert comprises a wear part comprising a cap comprising a wear surface and a mount comprising a cylindrical part having a cross-sectional area and a diameter, the method comprising:

grinding the cap and forming a front part with an extension along an axis of rotational symmetry of the insert from a first point on the wear surface of the cap to a second point in the cap, such that the front part comprises a volume between a first plane, which intersects at right angle to the axis of symmetry at the first point and a second plane, which intersects at right angle to the axis of symmetry at the second point, wherein the volume is equal to 0.6 times a cross-sectional area of the front part in the second plane times a distance along the axis of symmetry between the first point and the second point, wherein a diameter of the front part in the second plane is greater than or equal to 0.5 times the diameter of the mount and less than or equal to 0.6 times the diameter of the mount, wherein a height of the extension is less than half the diameter of the extension, and wherein the volume of the front part corresponds to a minimum volume of hard metal that is intended to be worn away during drilling, before the insert is reground, wherein the cap extends entirely around the axis of rotational symmetry.

15. The method according to claim 14, wherein the height of the extension is less than one third the diameter of the extension.

* * * * *